US008957886B2

(12) United States Patent
You et al.

(10) Patent No.: US 8,957,886 B2
(45) Date of Patent: Feb. 17, 2015

(54) POWER-SAVING AND CONTEXT-SHOWING DISPLAY INFORMATION CONVERTING SYSTEM AND CORRESPONDING APPARATUS

(75) Inventors: Tun-Hao You, Taipei County (TW); Yi-Jui Wu, Hsinchu (TW); Hsiang-Tsung Kung, Taipei (TW); Koan-Sin Tan, Hsinchu County (TW); Chen-Hwa Song, Taipei (TW); Yi-Jen Yeh, Miaoli County (TW)

(73) Assignee: Industrial Technology Research Institute, Hsinchu (TW)

( * ) Notice: Subject to any disclaimer, the term of this patent is extended or adjusted under 35 U.S.C. 154(b) by 718 days.

(21) Appl. No.: 13/005,540

(22) Filed: Jan. 13, 2011

(65) Prior Publication Data

US 2011/0181628 A1 Jul. 28, 2011

(30) Foreign Application Priority Data

Jan. 27, 2010 (TW) ..... 99102294 A

(51) Int. Cl.
*G09G 5/00* (2006.01)
*G09G 3/32* (2006.01)
*G09G 3/20* (2006.01)

(52) U.S. Cl.
CPC ..... *G09G 3/3208* (2013.01); *G09G 3/20* (2013.01); *G09G 2320/0613* (2013.01); *G09G 2320/062* (2013.01); *G09G 2320/0646* (2013.01); *G09G 2330/021* (2013.01); *G09G 2360/16* (2013.01)
USPC ..... 345/211; 345/76; 345/204; 345/690

(58) Field of Classification Search
USPC ..... 345/76–100, 204, 211–213, 690
See application file for complete search history.

(56) References Cited

U.S. PATENT DOCUMENTS 6,801,811 B2 * 10/2004 Ranganathan et al. ..... 700/22
7,389,432 B2 6/2008 Chandley et al.

(Continued)

FOREIGN PATENT DOCUMENTS

JP 2008252185 10/2008
TW 457792 10/2001

(Continued)

OTHER PUBLICATIONS

"Office Action of Japan Counterpart Application", issued on Sep. 4, 2012, p. 1-p. 2.

(Continued)

*Primary Examiner* — Jennifer Nguyen
(74) *Attorney, Agent, or Firm* — Jianq Chyun IP Office

(57) ABSTRACT

A context-showing and power-saving display information converting system and a corresponding apparatus are provided for lowering the power consumption of displaying images on a pixel self-emissive display device. The display information converting system includes a context-showing module and a power-saving conversion module. The context-showing module receives display information that describes the content of an image, wherein the display information includes one or more elements, and each element corresponds to a plurality of pixels displayed by a display device. In addition, the context-showing module determines a relevance of the one or more elements according to the viewing interest of the user. The power-saving conversion module converts the display information in unit of the one or more elements according to the relevance and provides the converted display information to the display device.

15 Claims, 8 Drawing Sheets

(56) References Cited

U.S. PATENT DOCUMENTS

| | | | | |
|---|---|---|---|---|
| 8,218,895 | B1 * | 7/2012 | Gleicher et al. | 382/275 |
| 2003/0135288 | A1 | 7/2003 | Ranganathan et al. | |
| 2005/0088461 | A1 * | 4/2005 | Bhogal | 345/690 |
| 2007/0211083 | A1 * | 9/2007 | Lee et al. | 345/690 |
| 2008/0216117 | A1 * | 9/2008 | Lee et al. | 725/39 |

FOREIGN PATENT DOCUMENTS

| | | |
|---|---|---|
| TW | 507160 | 10/2002 |
| TW | I220356 | 8/2004 |
| WO | 2007125960 | 11/2007 |

OTHER PUBLICATIONS

Harter et al., "Energy-aware User Interfaces: An Evaluation of User Acceptance", CHI 2004, Apr. 24-29, 2004, Vienna, Austria, pp. 1-8.

Iyer et al., "Energy-Adaptive Display System Designs for Future Mobile Environments", The Proceedings of MobiSys 2003: The 1st International Conference on Mobile Systems, Applications, and Services, May 5-8, 2003, San Francisco, CA, pp. 1-15.

"Office Action of Taiwan Counterpart Application", issued on Jan. 23, 2014, p. 1-p. 5.

* cited by examiner

POWER-SAVING AND CONTEXT-SHOWING DISPLAY INFORMATION CONVERTING SYSTEM AND CORRESPONDING APPARATUS

CROSS-REFERENCE TO RELATED APPLICATION

This application claims the priority benefit of Taiwan application serial no. 99102294, filed on Jan. 27, 2010. The entirety of the above-mentioned patent application is hereby incorporated by reference herein and made a part of this specification.

1. Technical Field

The present disclosure relates to a power-saving and context-showing display information converting system and a corresponding apparatus.

2. Background

An organic light-emitting diode (OLED) display is a self-emissive device and offers a high contrast ratio, a wide viewing angle, and a thin-body implementation. Thus, in recent years, many display manufacturers have placed their focus on the development of OLED displays.

The power consumed by an OLED display is a function of the displayed image when running at a fixed voltage because the light intensity of OLED is proportional to the current magnitude. This differs from the thin film transistor liquid crystal display (TFT-LCD) where the power consumed is mostly determined by the intensity of the backlight, and is generally independent of the content to be displayed. For example, while consuming no power when displaying a dark image, an OLED display may consume several times more power than a comparable TFT-LCD when displaying a bright image.

Most existing application programs' graphical user interfaces and web pages provide a color theme with light background and dark foreground, e.g., black glyphs on white background. Since the entire image presents a high degree of brightness, much more power will be consumed when an OLED display is used instead of a TFT-LCD. This calls for techniques of converting display images for reduced power consumption of OLED displays.

FIGS. 1-3 are diagrams depicting conventional display image conversion techniques. Referring to FIG. 1, the display image 110 includes two windows 120 and 130, and the user's focus falls on the window 130. Under the conversion technique illustrated in FIG. 2, the window focused by the user is kept unchanged, while the other window and the background image are darkened to reduce the power consumption. As shown in FIG. 2, the focused window 130 remains unchanged, while the brightness of the other window 120 and the background image 115 is decreased.

FIG. 3 illustrates another conventional display image conversion technique. As shown in FIG. 3, the display image 310 includes a window 320 and two text blocks 330 and 340. According to the conversion technique illustrated in FIG. 3, the display image 310 is divided into five stripe-shaped display areas 351-355. The brightness of the display area currently viewed by a user is kept unchanged, while the brightness of any other display area is decreased according to its distance from the area under viewing. As shown in FIG. 3, the brightness of the display area 353 currently viewed by the user remains unchanged, the neighboring display areas 352 and 354 are displayed in lower brightness, and the farther display areas 351 and 355 are displayed in even lower brightness. Even though this technique can reduce the power consumption of an OLED display device, significant portions of the display image may be invisible or near-invisible to the user, which may not be what the user wants. For example, only a part of the window 320 and a part of the text block 340 retain their original brightness, while the other parts are immersed in darkness or near-darkness.

SUMMARY

Accordingly, the present disclosure is directed to a display information converting system and a display information converting apparatus, wherein when the system and the apparatus convert a given image, the system and the apparatus take both the power consumption for displaying the image and the context of the image for a user's easy viewing into consideration.

The present disclosure provides a display information converting system including a context-showing module and a power-saving conversion module. The context-showing module receives display information that describes the content of a given image. The display information includes one or more elements. Each element corresponds to a plurality of pixels to be displayed by a display device. The context-showing module determines at least one relevance of each element. There may be four relevance conditions to determine the relevance, including the display distance between two elements, the statistical result of user browsing sequences, the one or more elements corresponding to some control actions, the application flow of the display information, or any combination of above conditions. The power-saving conversion module converts the display information according to the at least one relevance of each element and provides the resulting converted display information to the display device. Each element is a unit of the conversion of the display information. The converted display information reduces the power consumed for displaying the given image.

The present disclosure further provides a display information converting apparatus including a storage device and a processor. The storage device stores a context-showing model and a power-saving conversion model. The processor receives display information that describes the content of a given image. The display information includes one or more elements. Each element corresponds to a plurality of pixels to be displayed by a display device. The processor determines at least one relevance of each element according to the context-showing model, converts the display information according to the power-saving conversion model and the at least one relevance of each element, and provides the converted display information to a display device. Each element is a unit of the conversion of the display information. The converted display information reduces the power consumed for displaying the image.

The present disclosure further provides a display information converting system that is configured by receiving display information comprising one or more elements, selecting at least one prominent element from the one or more elements, determining at least one relevance of each element according to the prominent element, converting the display information according to the at least one relevance of each element, and providing the resulting converted display information to a display device. Each element corresponds to a plurality of pixels to be displayed by a display device and is a unit of the conversion of the display information. The prominent element is a flow element, a focus element, a markup element, a significant element, or an interest element. A flow element is an element currently corresponding or related to the application flow of an application program or a web page. A focus element is located at the position fixated by the user of the display device or the position pointed by an input device. A markup element is set according to the types and attributes of each element, which is defined by system administrators, designers, or users. A significant element is set automatically by the display information converting system. An interest element is set according to viewing frequency, click frequency, or the display size proportion of each element in the display information.

BRIEF DESCRIPTION OF THE DRAWINGS

Figure 1:
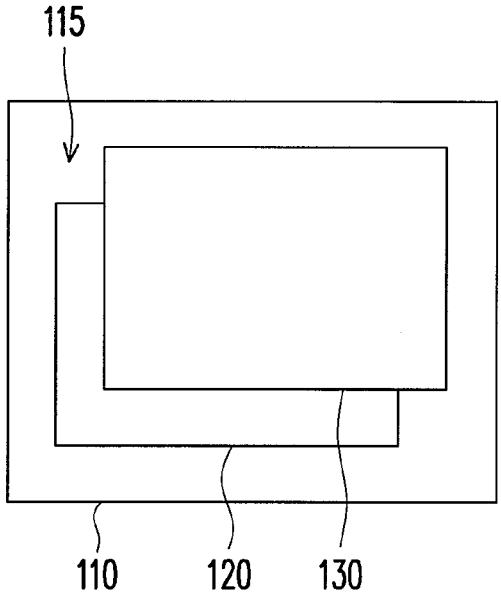
FIG. 1 (RELATED ART)
Figure 2:
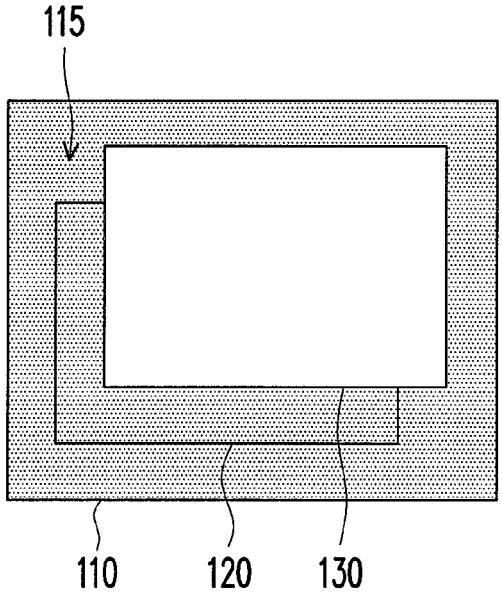
FIG. 2 (RELATED ART)
Figure 3:
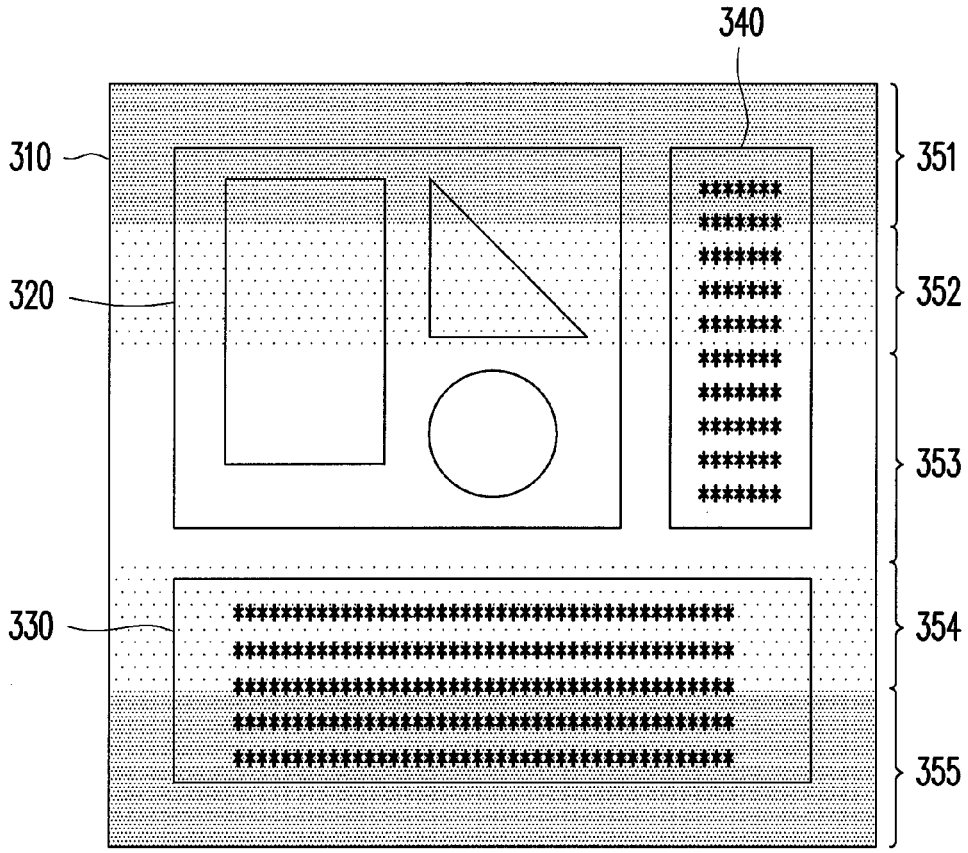
FIG. 3 (RELATED ART)

Having thus described the application in general terms, reference will now be made to the accompanying drawings, which are not necessarily drawn to scale, and wherein:

FIG. 1, FIG. 2, and FIG. 3 are schematic diagrams of conventional power-saving converting methods.

Figure 4:
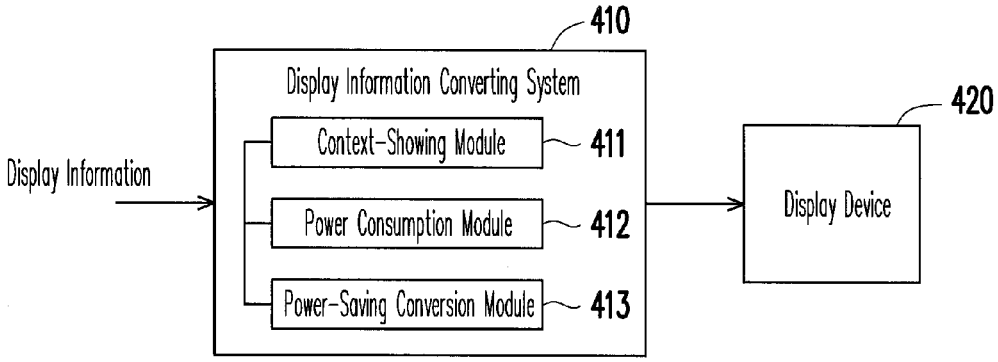

FIG. 4 is a schematic diagram of a display information converting system according to an exemplary embodiment of the present disclosure.

Figure 5:
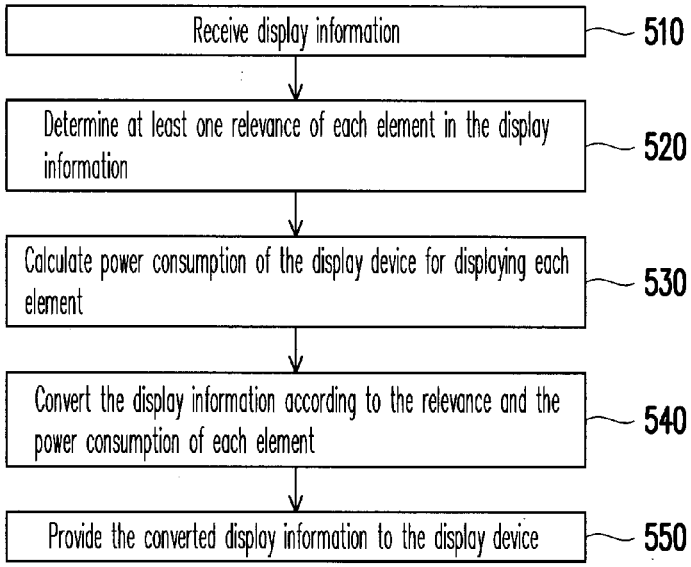
Figure 6:
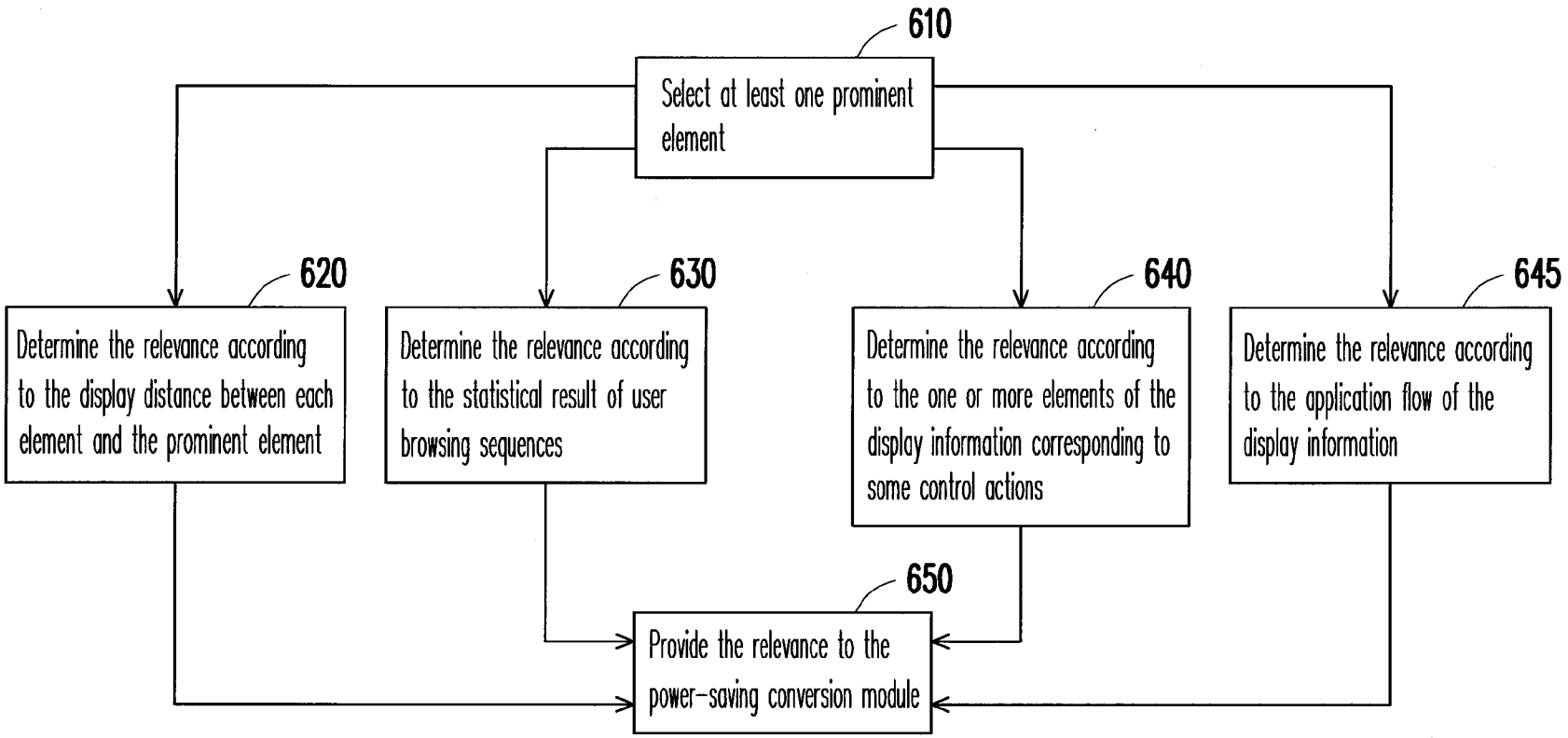

FIG. 5 and FIG. 6 are flowcharts of a display information converting method according to the exemplary embodiment of FIG. 4.

FIG. 7, FIG. 8, FIG. 9, and FIG. 10 are schematic diagrams illustrating the relevance of each element according to the embodiment of FIG. 4.

Figure 11:
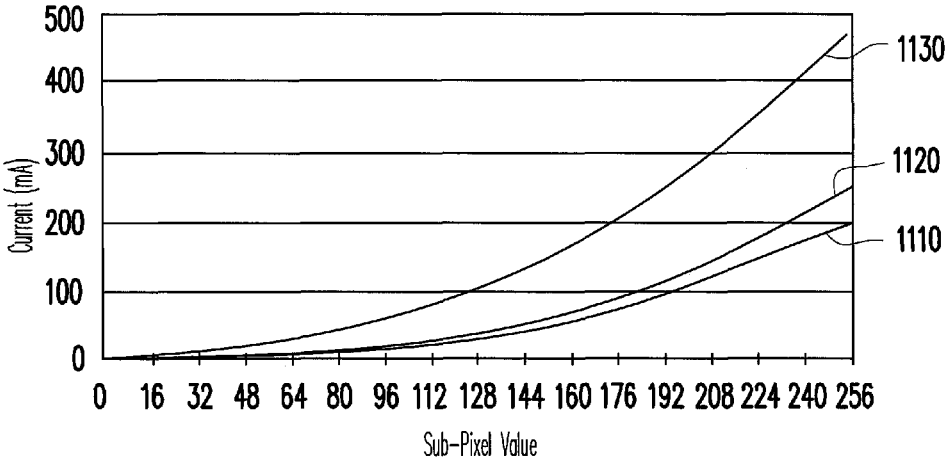

FIG. 11 is a schematic diagram of a power consumption model according to the embodiment of FIG. 4.

Figure 12:
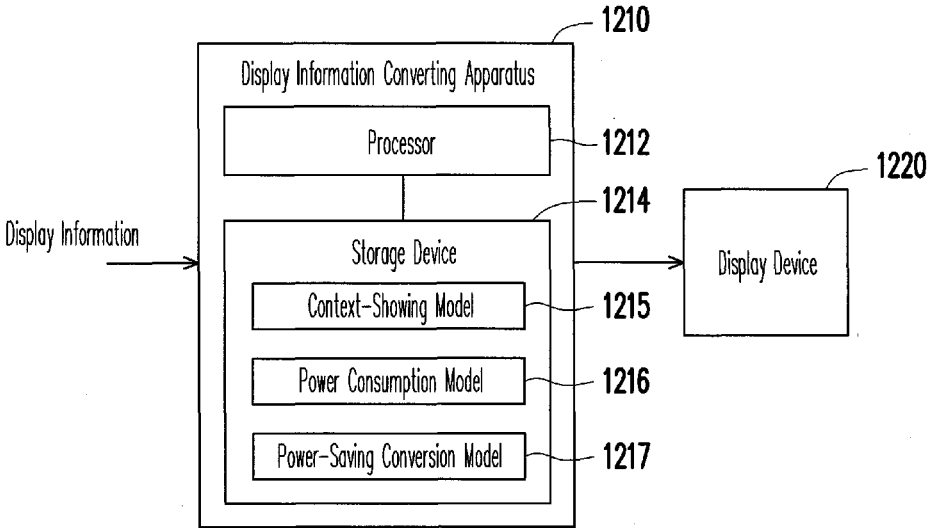

FIG. 12 is a schematic diagram of a display information converting apparatus according to another exemplary embodiment.

DESCRIPTION OF THE EMBODIMENTS

Some embodiments of the present application will now be described more fully hereinafter with reference to the accompanying drawings, in which some, but not all embodiments of the application are shown. Indeed, various embodiments of the application may be embodied in many different forms and should not be construed as limited to the embodiments set forth herein; rather, these embodiments are provided so that this disclosure will satisfy applicable legal requirements. Like reference numerals refer to like elements throughout.

FIG. 4 is a diagram of a display information converting system 410 according to a first embodiment of the present disclosure, and FIG. 5 is a flowchart of a display information converting method executed by the display information converting system 410. The display information converting system 410 may be hardware or software, e.g., a proxy server or a web browser, respectively.

The display information converting system 410 includes a context-showing module 411, a power consumption module 412, and a power-saving conversion module 413. Each of the context-showing module 411, the power consumption module 412, and the power-saving conversion module 413 may be hardware or software. First, at step 510, the context-showing module 411 receives display information. The display information describes the content of an image to be displayed by a display device 420, such as a web page or the graphical user interface of an application program. The display information includes one or more elements, and each element corresponds to a plurality of pixels to be displayed by the display device 420. Each element may include an image or an image descriptor set. The image is directly displayed by the display device 420. The image descriptor set may include one or more image descriptors, wherein each image descriptor may be a piece of markup language code or program code. For example, each image descriptor may be a piece of Hyper Text Markup Language (HTML), a piece of Extensible Markup Language (XML), or a piece of computer program code for generating an image. The image descriptor set is processed by software or hardware of the display device 420 to generate an image to be displayed by the display device 420. The display device 420 is a pixel self-emissive display device that does not require a backlight, such as an organic light-emitting diode (OLED) display.

After receiving the display information, the context-showing module 411, at step 520, determines at least one relevance of each element in the display information. The power consumption module 412 calculates the power consumption of the display device 420 for displaying each of the elements at step 530. The power-saving conversion module 413, at step 540, converts the display information according to the relevance and the power consumption of each element and, at step 550, provides the resulting converted display information to the display device 420. Each element is a unit of the conversion of the display information. The converted display information effectively reduces the power consumption for displaying the image. Namely, the power consumption of the display device 420 for displaying the converted display information is lower than that for displaying the original display information.

FIG. 6 is a detailed flowchart of step 520 in FIG. 5. First, at step 610, the context-showing module 411 selects at least one prominent element from the one or more elements. The prominent element may be a flow element, a focus element, a markup element, a significant element, or an interest element. The flow element is an element currently corresponding or related to the application flow of an application program or a web page. The application flow refers to the order in which a user is expected to use the application program or browse the web page, as specified by the designer of the application program or the web page. For example, if the application program is a movie player, because the user is likely to click on the progress bar while watching the movie to control the movie to run forward or backward, the progress bar or the entire area for playing the movie may be set as the flow element. If the user is browsing the headlines of a particular news website, because the user is likely to click on a hyperlink related to the headlines, the hyperlink may be set as the flow element. The application program can set the flow element to a specific type, attribute, or both, and correspondingly the context-showing module 411 can identify the flow element according to the type and attribute of an element.

The focus element refers to an element located at the position fixated by the user of the display device 420, or a position pointed by an input device, such as mouse, keyboard, or touch screen. The markup element is an element considered significant by the user of the display device 420, an administrator of the display information converting system 410, or the designers of the application program or the web page. For example, the markup element may be the logo of a website. The markup element can be predetermined according to the types and attributes of the elements. The significant element is an element considered significant automatically by the display information converting system 410 according to the attributes associated with the element, according to the statistical result of user's browsing habit, or according to any convention and prior art. For example, the significant element may be the title of an article in a web page or an interface control element such as a button. The interest element is set according to the viewing frequency, the click frequency, or the display size proportion of each element in the display information. For example, the interest element may be words having the highest user click frequency in a web page or words having their display size proportions greater than a specific threshold.

Next, the context-showing module 411 determines the at least one relevance of the one or more elements to the viewing interest of the user. As shown in the present embodiment, there may be four relevance conditions to determine the relevance of the one or more elements, which are described in details below. The four relevance conditions may be used individually or in any combination.

Figure 7:
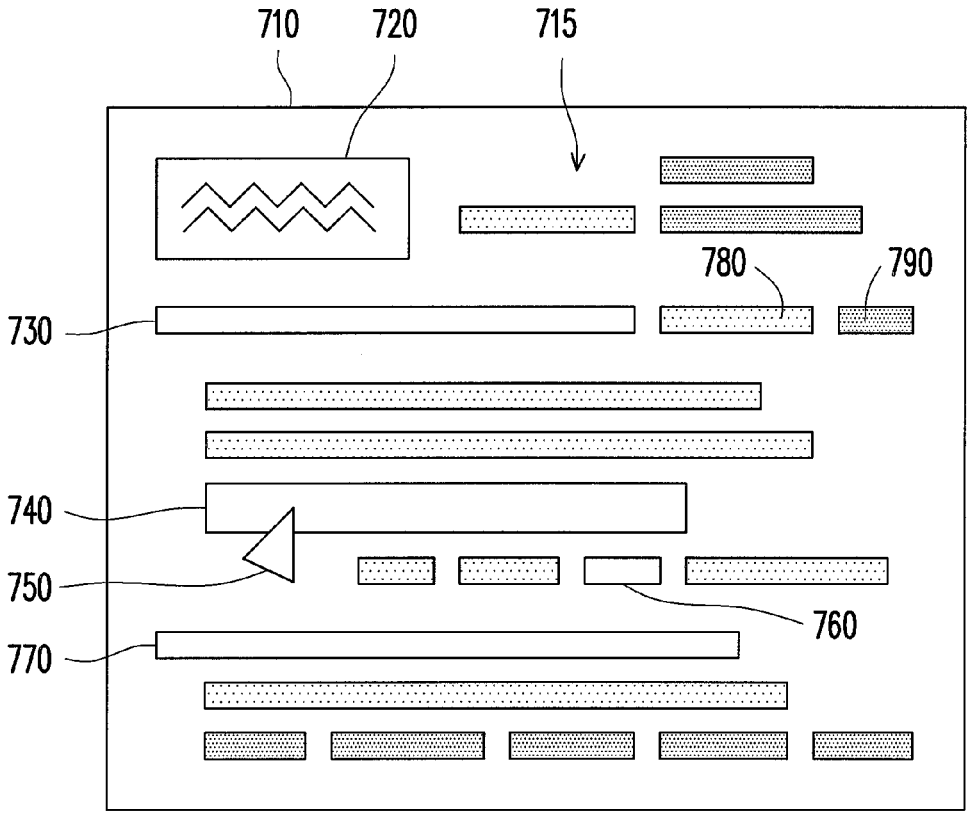
Figure 8:
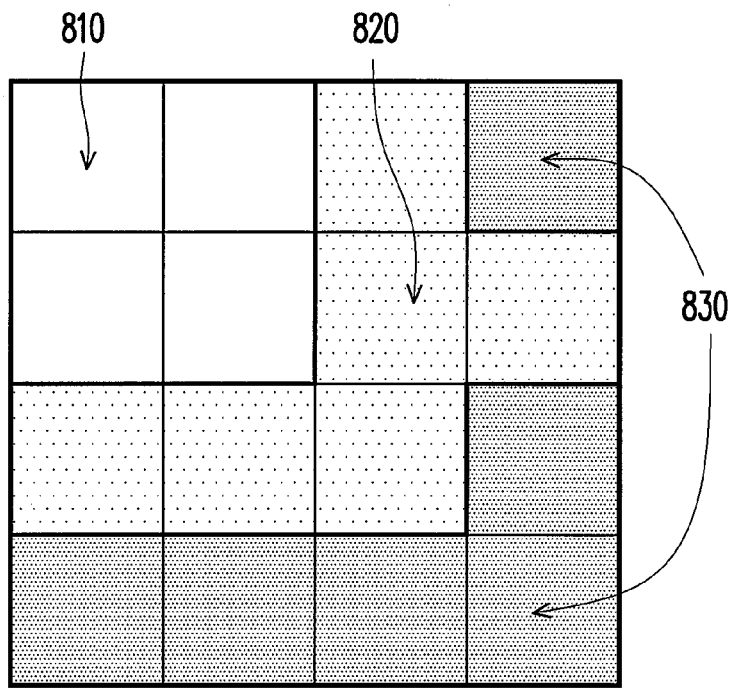

The first relevance condition is to determine the relevance of the one or more elements, at step 620, according to the display distance between each element and the prominent element. The display distance can be the physical distance metrics, such as centimeter, or the relative distance metrics, such as the number of elements or any metrics in prior literature. FIG. 7 illustrates a web page 710 browsed by the user. Elements 720, 730, 740, 760, and 770 are all prominent elements. The logo 720 of the website is categorized as a markup element. The titles 730 and 770 are categorized as significant elements. The element 740 pointed by the mouse cursor 750 is categorized as a focus element. The element 760 is a word with high click frequency therefore it is categorized as an interest element. The context-showing module 411 sets the prominent elements to have the highest level of relevance, the one or more elements outside the prominent elements, e.g., the element 780, to have the next highest level of relevance, the one or more elements at even further outside, e.g., the element 790, to have a lower level of relevance, and so on. The image background 715 is set to have the lowest level of relevance.

The second relevance condition is to determine the relevance according to the statistical result of user browsing sequences, at step 630. In the example illustrated in FIG. 8, the statistical result shows that the user first views the content of the display area 810, then the content of the display area 820, and finally the content of the display area 830. In this case, the context-showing module 411 sets the relevances of display areas 810, 820, and 830 to have the highest, the middle, and the lowest level, respectively.

Figure 9:
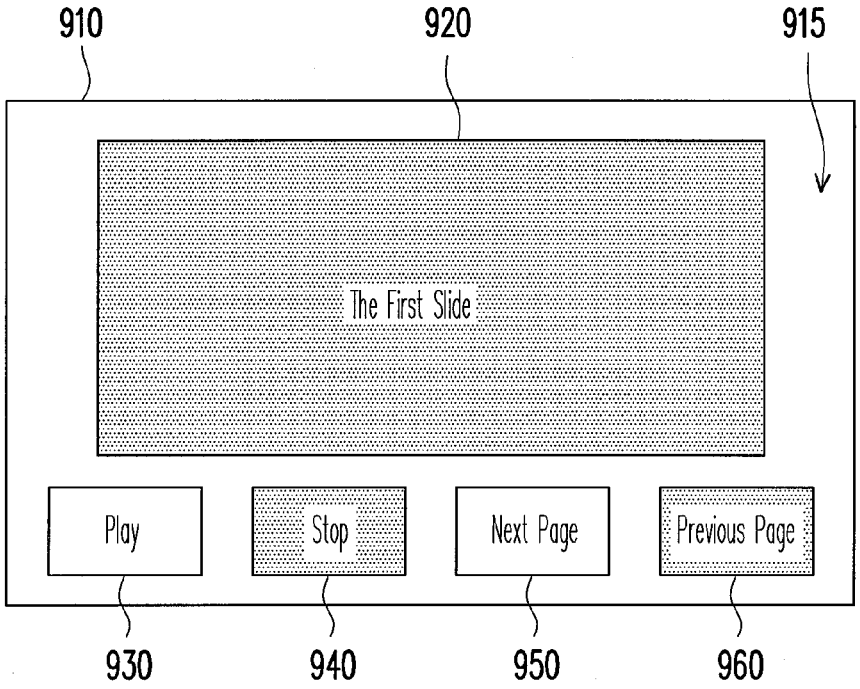

The third relevance condition is to determine the relevance according to the one or more elements of the display information corresponding to some control actions, at step 640. FIG. 9 illustrates the user interface of specific presentation software. Assuming that the control actions "play" and "next page" are currently allowed, the context-showing module 411 sets the virtual buttons 930 and 950 corresponding to these two control actions to the highest level of relevance, sets the slide display area 920 and the other two virtual buttons 940 and 960 to the middle level of relevance, and sets the image background 915 to the lowest level of relevance. The application program may set the element corresponding to a control action according to the attribute of the element so that the context-showing module 411 can identify the element.

Figure 10:
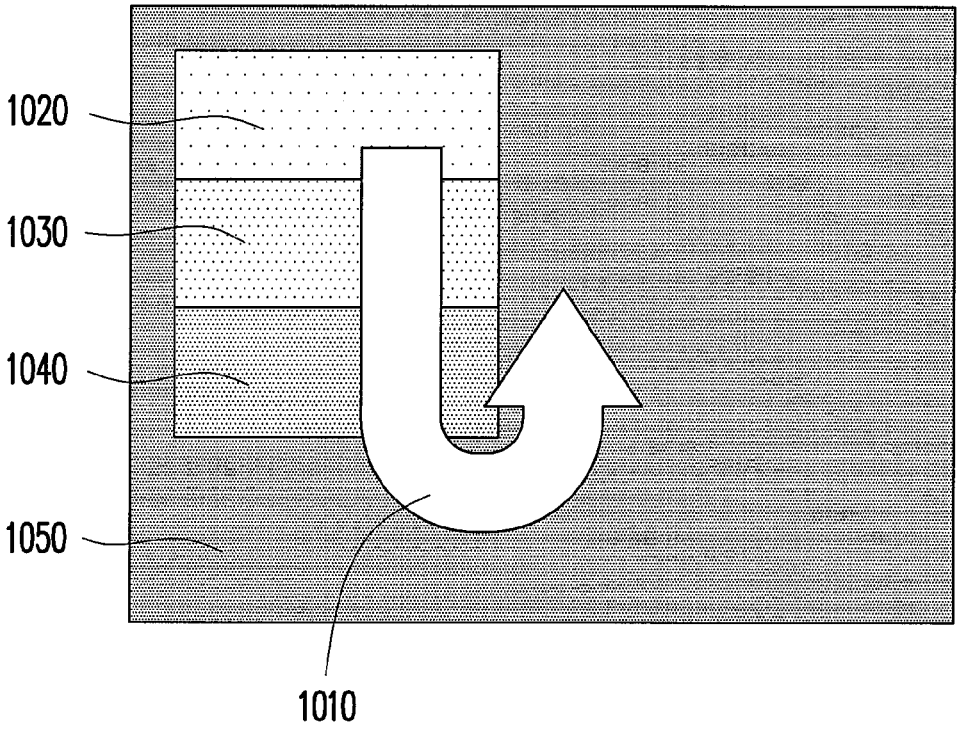

The fourth relevance condition is to determine the relevance according to the application flow of the display information, at step 645. As described above, the application flow refers to the order in which the user is expected to use the application program or browse the web page, as specified by the designer of the application program or the web page, as shown in FIG. 10. If the arrow 1010 indicates the browsing order expected by the designer of the web page, the four areas 1020, 1030, 1040, and 1050 of the web page may be sequentially set to decreasing relevances based on the browsing order.

The four relevance conditions for determining the relevance described above can be used either separately or in a weighted combination. Thereafter, the context-showing module 411 provides the relevance to the power-saving conversion module 413, at step 650.

The power-saving conversion module 413 sets the prominent elements to a predetermined brightness or a predetermined size, sorts the other elements according to the relevance, and sets the other elements to decreasing brightness or sizes according to the sorted sequence of relevance. Namely, a brightness- or size-decreasing sequence is formed with all the elements and the prominent elements at the beginning. The lower relevance an element has, the lower brightness or smaller display size the element is set to.

The power consumption module 412 calculates the power consumption for displaying each element in the display information. Meanwhile, the power-saving conversion module 413 determines how to convert each element, i.e., setting the brightness or size of the element, according to the relevance and the power consumption of the element. The overall power consumption of the display information is obtained by adding up the power consumption of each element. If the overall power consumption of the display information is low, the power-saving conversion module 413 may set the predetermined brightness of the prominent elements to the maximum brightness of the display device 420 and set the other elements to decreasing brightness according to the relevances of these elements. In order to allow the user to see all elements easily, the brightness of each element can be restricted to be not lower than a specific predetermined threshold. Namely, no element will disappear from the image during the conversion. On the other hand, if the overall power consumption of the display information is high, the power-saving conversion module 413 can set the predetermined brightness of the prominent elements to a lower brightness and set those elements having their relevances lower than a predetermined threshold to full dark, i.e., not displayed. Foregoing brightness conversion rule can also be followed if the power-saving conversion module 413 converts the display information by changing the size of each element. Through this technique, the overall power consumption after the conversion of the display information can be effectively controlled and accordingly less power will be consumed.

The power consumption module 412 calculates the power consumption for displaying each element by using a power consumption model of the display device 420. Each display device of a specific brand and model has its own power consumption model. The information provided by a power consumption model includes the power consumptions of a single pixel in the display device for displaying various levels of brightness and various colors. The power consumption model can be obtained from the power consumption data provided by the manufacturer of the display device or from the actual power consumption measurement of the display device.

FIG. 11 illustrates the current consumption curves provided by the manufacturer of the display device 420. The display device 420 has a resolution of 800*480 pixels, and each pixel is composed of a red sub-pixel, a green sub-pixel, and a blue sub-pixel. FIG. 11 illustrates the current consumptions of the display device 130 when a single color is displayed, wherein the curves 1110, 1120, and 1130 represent the current consumption corresponding to the red sub-pixel, the green sub-pixel, and the blue sub-pixel, respectively. The current consumed by a single pixel for displaying any color and any brightness can be obtained by dividing the currents corresponding to the curves 1110, 1120, and 1130 by 800*480, respectively. Since an OLED display has a fixed pixel driving voltage, the power consumption of the pixel is in direct ratio to the current. Namely, the power consumption of each pixel is determined by its sub-pixel values. The power consumption of each pixel in the image can be derived from the power consumption model in FIG. 11, and the power consumption of each element can be obtained by adding up the power consumptions of all the pixels of the element.

FIG. 12 is a diagram of a display information converting apparatus 1210 according to a second embodiment of the present disclosure. The display information converting apparatus 1210 includes a processor 1212 and a storage device 1214. The display information converting apparatus 1210, the processor 1212, and the storage device 1214 are all hardware. The storage device 1214 stores a context-showing model 1215, a power consumption model 1216, and a power-saving conversion model 1217. The context-showing model 1215, the power consumption model 1216, and the power-saving conversion model 1217 include a plurality of algorithms and models and are equivalent to the context-showing module 411, the power consumption module 412, and the power-saving conversion module 413 in FIG. 4, respectively. The processor 1212 executes the display information converting method illustrated in FIGS. 5-9 by using these three models, and the display device 1220 displays the converted display information. Other details and aspects of the present embodiment have been described in the first embodiment of the present disclosure therefore will not be described herein.

As described above, in the present disclosure, the atomic unit of conversion of a display image or a given image is elements in the display information instead of pixels. Thus, not only the power consumption of a pixel self-emissive display device is reduced, but also the context of the image for a user's easy viewing is taken into consideration so that all the elements of relevance higher than certain thresholds in the display information can be displayed.

In the display information converting system and the display information converting apparatus described above, the basic unit of the conversion of display information is each element instead of each pixel. This allows only those less relevant elements, which have no significant viewing interests to the user, to be darkened or to be smaller. Thereby, not only the power consumption is reduced, but the image context is also taken into consideration.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A display information converting system, comprising:

a context-showing module, for receiving display information, wherein the display information comprises one or more elements, each element corresponds to a plurality of pixels to be displayed by a display device, and the context-showing module determines at least one relevance of the one or more elements; and a power-saving conversion module, for converting the display information according to the at least one relevance of the one or more elements and providing the converted display information to the display device, wherein each element is a unit of the conversion of the display information, wherein the context-showing module selects at least one prominent element from the one or more elements, and the prominent element is a flow element, a markup element, a significant element, or an interest element, wherein the flow element is an element currently corresponding or related to an application flow of an application program or a web page, wherein the markup element is set according to types and attributes of each element, wherein the significant element is set automatically by the display information converting system, wherein the interest element is set according to a viewing frequency, a click frequency, or a display size proportion of each element in the display information, wherein the at least one relevance of the one or more elements is determined according to at least one of the following relevance conditions:

a display distance between the prominent element and each element, and an application flow of the display information, wherein the power-saving conversion module sets the prominent element to a predetermined size, sorts the other elements according to the at least one relevance, and sets the other elements to decreasing sizes according to the sorted sequence.

2. The display information converting system according to claim 1, wherein the display device is a pixel self-emissive display device.

3. The display information converting system according to claim 1, wherein the one or more elements comprise an image or an image descriptor set, the image is directly displayed by the display device, and the image descriptor set is processed by software or hardware of the display device to generate an image displayed by the display device.

4. The display information converting system according to claim 3, wherein the image descriptor set comprises at least one image descriptor, and the image descriptor is markup language code or program code.

5. The display information converting system according to claim 1, further comprising:

a power consumption module, for calculating power consumption of the display device for displaying each element, wherein the power-saving conversion module sets the predetermined size according to the power consumption of each element and determines how to convert each element according to the power consumption of each element.

6. The display information predetermined converting system according to claim 5, wherein the power consumption module calculates the power consumption of the display device for displaying each of the one or more elements by using a power consumption model, and the power consumption model is obtained from a power consumption data provided by the manufacturer of the display device or an actual power consumption measurement of the display device.

7. The display information converting system according to claim 1, wherein the power consumption of the display device for displaying the converted display information is lower than the power consumption of the display device for displaying the original display information.

8. A display information converting apparatus, comprising:

a storage device, for storing a context-showing model and a power-saving conversion model; and a processor, wherein the processor receives display information, the display information comprises one or more elements, and each element corresponds to a plurality of pixels to be displayed by a display device, the processor determines at least one relevance of the one or more elements according to the context-showing model, converts the display information in unit of the one or more elements according to the power-saving conversion model and the at least one relevance of the one or more elements, and provides the converted display information to the display device, wherein each element is a unit of the conversion of the display information, wherein the processor selects at least one prominent element from the one or more elements by using the context-showing model, and the prominent element is a flow element, a markup element, a significant element, or an interest element, wherein the flow element is an element currently corresponding or related to an application flow of an application program or a web page, wherein the markup element is set according to types and attributes of the one or more elements, wherein the significant element is set automatically by the display information converting system, wherein the interest element is set by the processor according to a viewing frequency, a click frequency, or a display size proportion of each element in the display information, wherein the at least one relevance of the one or more elements is determined according to at least one of the following relevance conditions:

a display distance between the prominent element and each element, and an application flow of the display information, wherein the processor sets the prominent element to a predetermined size according to the power-saving conversion model, sorts the other elements according to the at least one relevance, and sets the other elements to decreasing sizes according to the sorted sequence.

9. The display information converting apparatus according to claim 8, wherein the display device is a pixel self-emissive display device.

10. The display information converting apparatus according to claim 8, wherein at least one of the one or more elements comprises an image or an image descriptor set, the image is directly displayed by the display device, and the image descriptor set is processed by software or hardware of the display device to generate an image to be displayed by the display device.

11. The display information converting apparatus according to claim 10, wherein the image descriptor set comprises at least one image descriptor, and the image descriptor is markup language code or program code.

12. The display information converting apparatus according to claim 8, wherein the storage device further stores a power consumption model, and the processor calculates a power consumption of the display device for displaying each of the one or more elements according to the power consumption model, sets the predetermined size according to the power-saving conversion model and the power consumption of each element, and determines how to convert each element according to the power-saving conversion model and the power consumption of each element.

13. The display information converting apparatus according to claim 12, wherein the power consumption model is obtained from a power consumption data provided by the manufacturer of the display device or an actual power consumption measurement of the display device.

14. The display information converting apparatus according to claim 8, wherein the power consumption of the display device for displaying the converted display information is lower than the power consumption of the display device for displaying the original display information.

15. A display information converting system, configured by receiving display information comprising one or more elements, selecting at least one prominent element from the one or more elements, determining at least one relevance of the one or more elements according to a display distance between the prominent element and each element, converting the display information according to the at least one relevance of the one or more elements, and providing the converted display information to a display device, wherein each element corresponds to a plurality of pixels displayed by the display device, each element is a unit of the conversion of the display information, and the prominent element is a flow element, a markup element, a significant element, or an interest element, wherein the flow element is an element currently corresponding or related to an application flow of an application program or a web page, wherein the markup element is set according to types and attributes of each element, wherein the significant element is set automatically by the display information converting system, wherein the interest element is set according to a viewing frequency, a click frequency, or a display size proportion of each element in the display information, wherein the display information converting system sets the prominent element to a predetermined size, sorts the other elements according to the at least one relevance, and sets the other elements to decreasing sizes according to the sorted sequence.

* * * * *